United States Patent [19]

Larkfeldt

[11] 4,055,112

[45] Oct. 25, 1977

[54] PROCESS AND APPARATUS FOR VENTILATING OR TEMPERING ROOMS

[75] Inventor: Birger Larkfeldt, Jonkoping, Sweden

[73] Assignee: AB Svenska Flaktfabriken, Nacka, Sweden

[21] Appl. No.: 645,514

[22] Filed: Dec. 30, 1975

[30] Foreign Application Priority Data

Dec. 30, 1974 Sweden ..... 7416340

[51] Int. Cl.[2] ..... F24F 13/00; F24F 7/02

[52] U.S. Cl. ..... 98/33 A; 98/40 D; 98/40 C; 98/40 N; 98/36

[58] Field of Search ..... 98/33 A, 36, 40 D, 40 N, 98/40 C, 40 DL; 237/46; 62/411

[56] References Cited

U.S. PATENT DOCUMENTS

| | | | |
|---|---|---|---|
| 2,962,953 | 12/1960 | Ashley | 98/40 N |
| 3,199,432 | 8/1965 | Brandi | 98/41 R |
| 3,320,404 | 5/1967 | Roux | 98/40 DL |
| 3,881,402 | 5/1975 | Larkfeldt | 98/40 N |
| 3,927,827 | 12/1975 | Strindehag | 98/40 N |

FOREIGN PATENT DOCUMENTS

| | | | |
|---|---|---|---|
| 145,568 | 5/1936 | Austria | 98/33 A |
| 846,341 | 9/1939 | France | 98/40 N |
| 590,879 | 12/1933 | Germany | 98/40 N |
| 1,237,694 | 6/1971 | United Kingdom | 98/36 |
| 481,991 | 3/1938 | United Kingdom | 98/36 |

*Primary Examiner*—John J. Camby
*Assistant Examiner*—Henry C. Yuen
*Attorney, Agent, or Firm*—Howson and Howson

[57] ABSTRACT

Process and apparatus for controlling the flow of ventilating-tempering air in a room to cause the flow to remain primarily along the walls, ceiling and floor, thereby to achieve better distribution of incoming air and more uniform room temperatures without uncomfortable drafts in the main body of the room. To accomplish this, the ventilating-tempering air is initially launched into the room along a boundary surface such as a wall or ceiling, and nozzles below the ceiling form air screens or jets below the ventilating-tempering air stream to guide it along the ceiling and down the walls. An intermediate grate-like ceiling of crossed lamellae is also preferably used to aid in separating ventilating-tempering air stream from the main center of the room.

13 Claims, 11 Drawing Figures

FIG. 3

PROCESS AND APPARATUS FOR VENTILATING OR TEMPERING ROOMS

The present invention concerns a process and apparatus for ventilating and/or tempering rooms. As used herein, the term "tempering" comprises heating or cooling, and the term "ventilating-tempering" means ventilating and/or tempering.

It is already known to temper or ventilate a room by blowing streams of air into it. These streams usually at first follow a wall or a section of a wall, and then become generally distributed, i.e. they wash over the greater part of the room-space, and finally leave it through outlet valves or in some other known way. By regulating the speed and temperature of the inflowing air, consideration can be given to various ventilating and tempering requirements. It is in itself possible to conduct to a room exactly the desired quantity of fresh air per time unit. At the same time, or independently, it is possible to temper a room precisely.

To obtain the aforesaid objective it is however necessary, with conventional processes and contrivances, to put up with negative secondary effects, which occur chiefly in the form of drafts troubling people in the room. This problem can not be eliminated by slowing the speed of the inflowing air, because that would result in nonuniform ventilation of the room, whereby in certain regions practically no flow of fresh air would occur and no renewal of this air, with an irregular distribution of temperature as a result. Another negative effect can appear under various temperature conditions, in particular with various outdoor temperatures. If, for example, relatively warm air is supplied while outdoor temperatures are relatively low, and it is in particular supplied at low speed, then the warm air displays a tendency to collect under the ceiling of the room, while the zone directly over the floor of the locality is covered by a layer of much lower temperature air which has no opportunity to become mixed with the warm air. There are also hitherto-unsolved problems in supplying relatively cold air under, for example, relatively high outdoor temperatures. In order that this cold air may flow through the greater part of the room. it is necessary for it, because of its greater specific weight, to be introduced up high, or at least be directed upward. However the supply arrangement may be solved, the relatively cold air will sink to the floor, producing drafts for the persons in the locality.

The above enumeration is in no way complete, things being such that further negative secondary effects occur with the known process and contrivances, which grow in seriousness as greater requirements are made for the ventilating and heating of a room.

The invention counteracts the aforesaid drawbacks, and eliminates them as far as is possible.

In accordance with the invention the above problem is solved by the apparatus and process of the appended claims. Details of specific embodiments of the invention are described in the following with particular reference to the appended drawings, in which:

Figure 1:
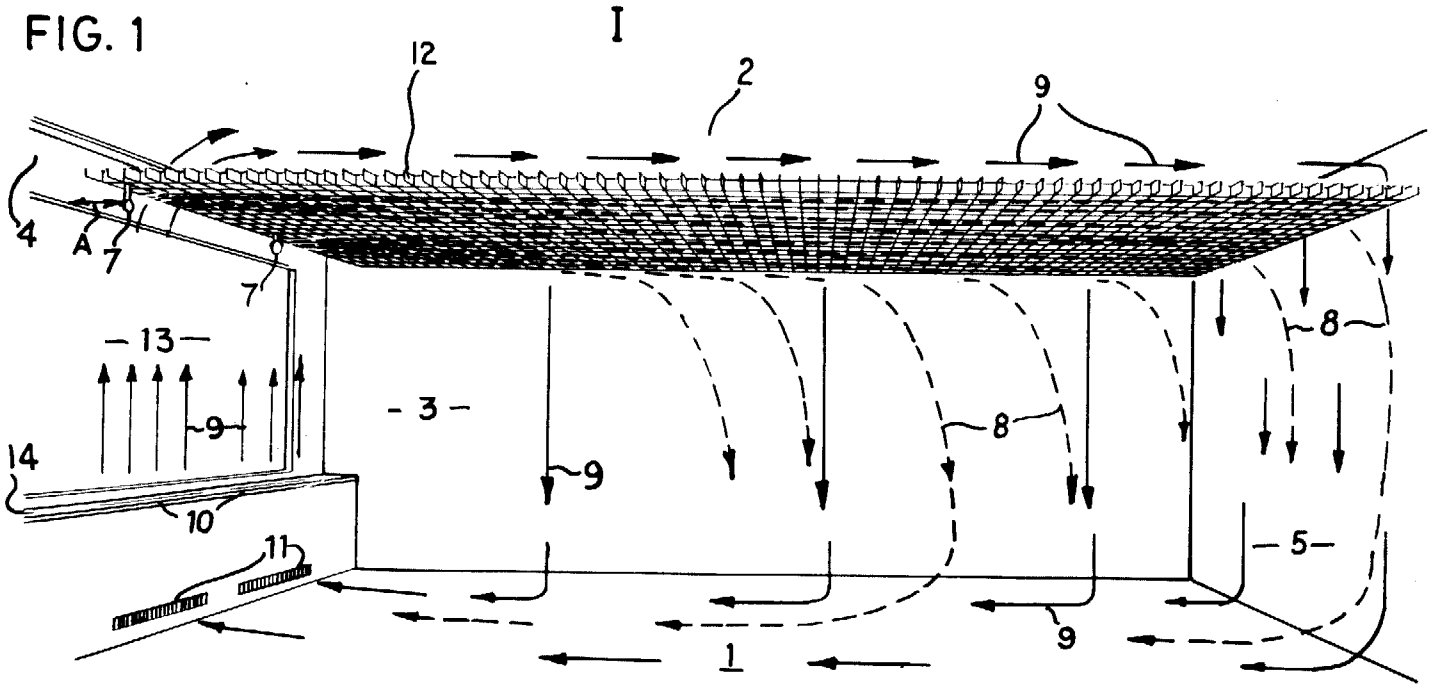
FIG. 1 is a perspective view of a room ventilated in accordance with the process of the invention, as seen from the side.
Figure 2:
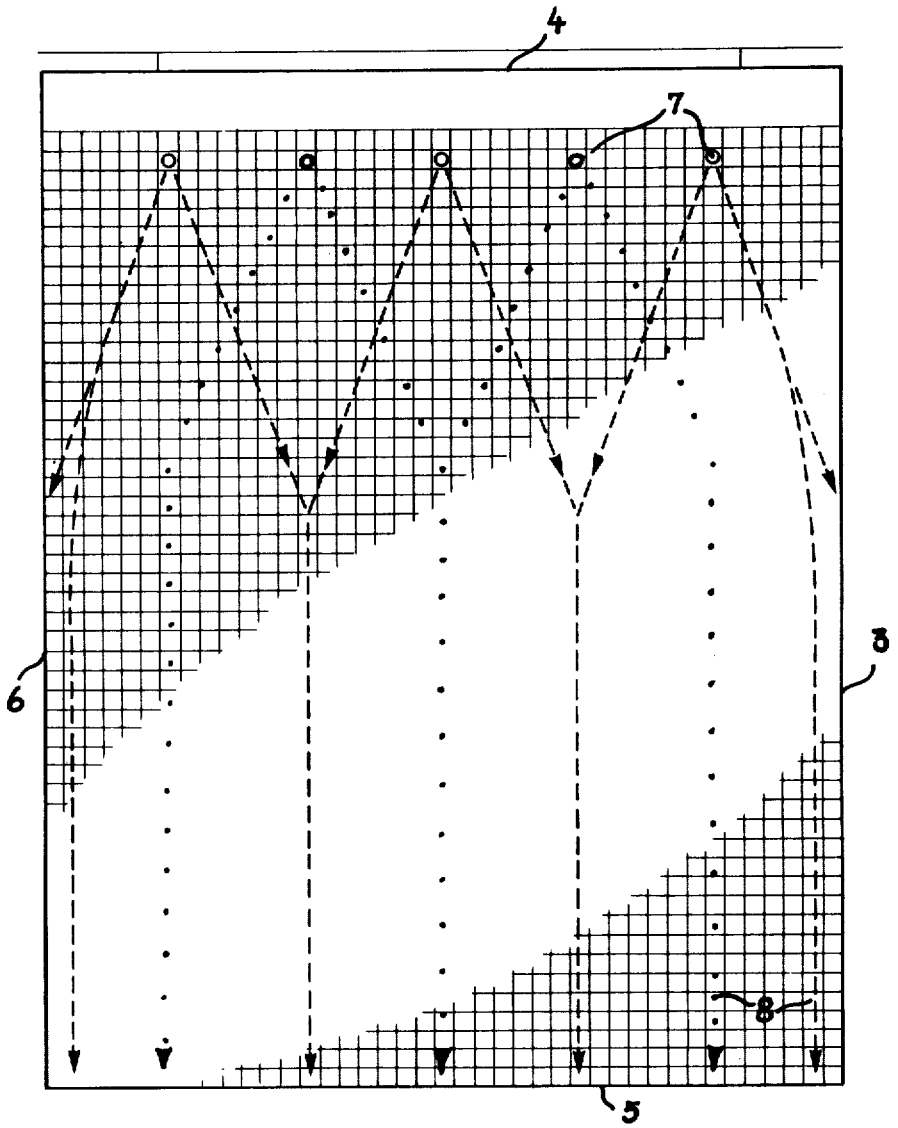
FIG. 2 is the room of FIG. 1, as seen from above.
Figure 3:
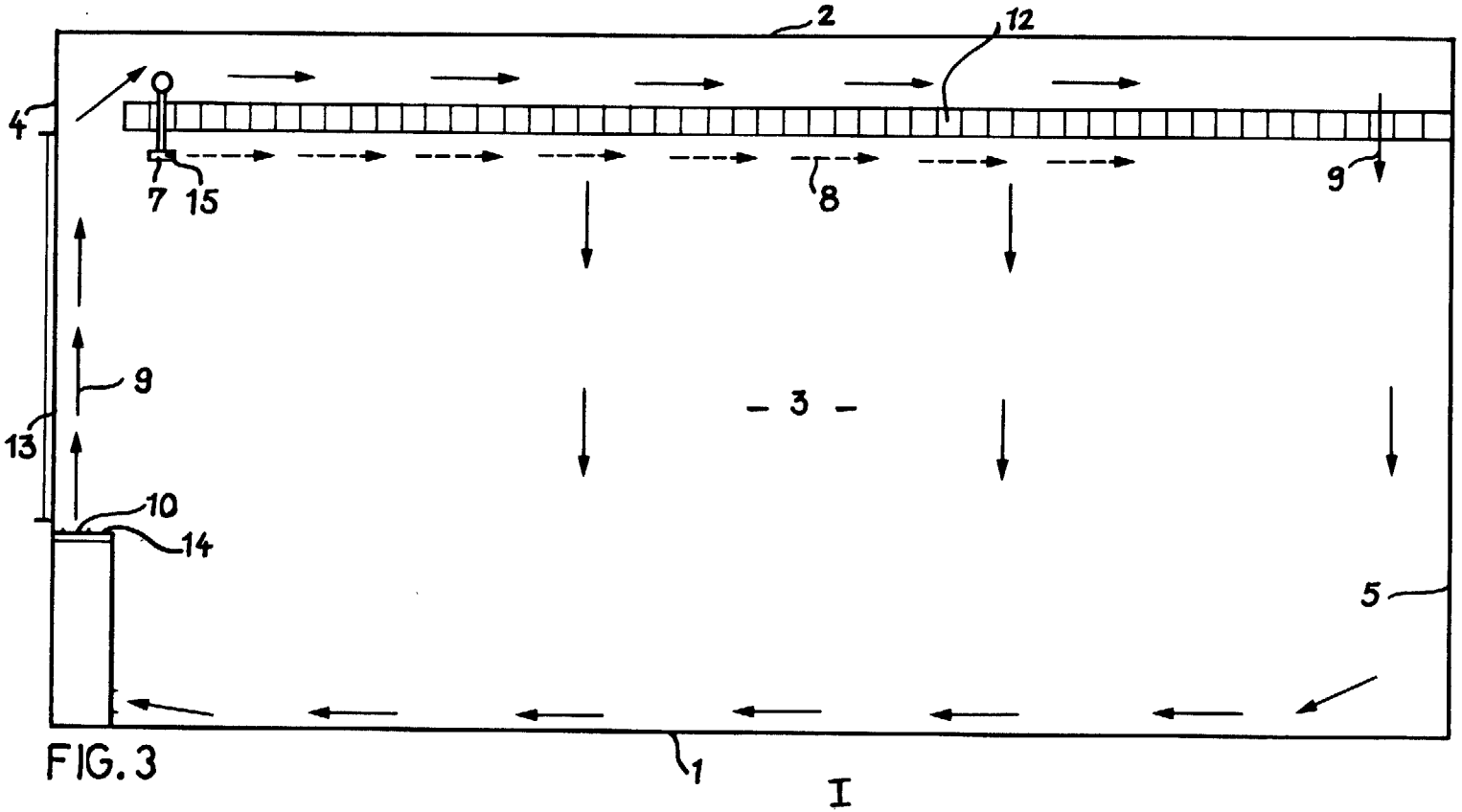
FIG. 3 shows the room of FIG. 1 in an isometric side view.
Figure 4:
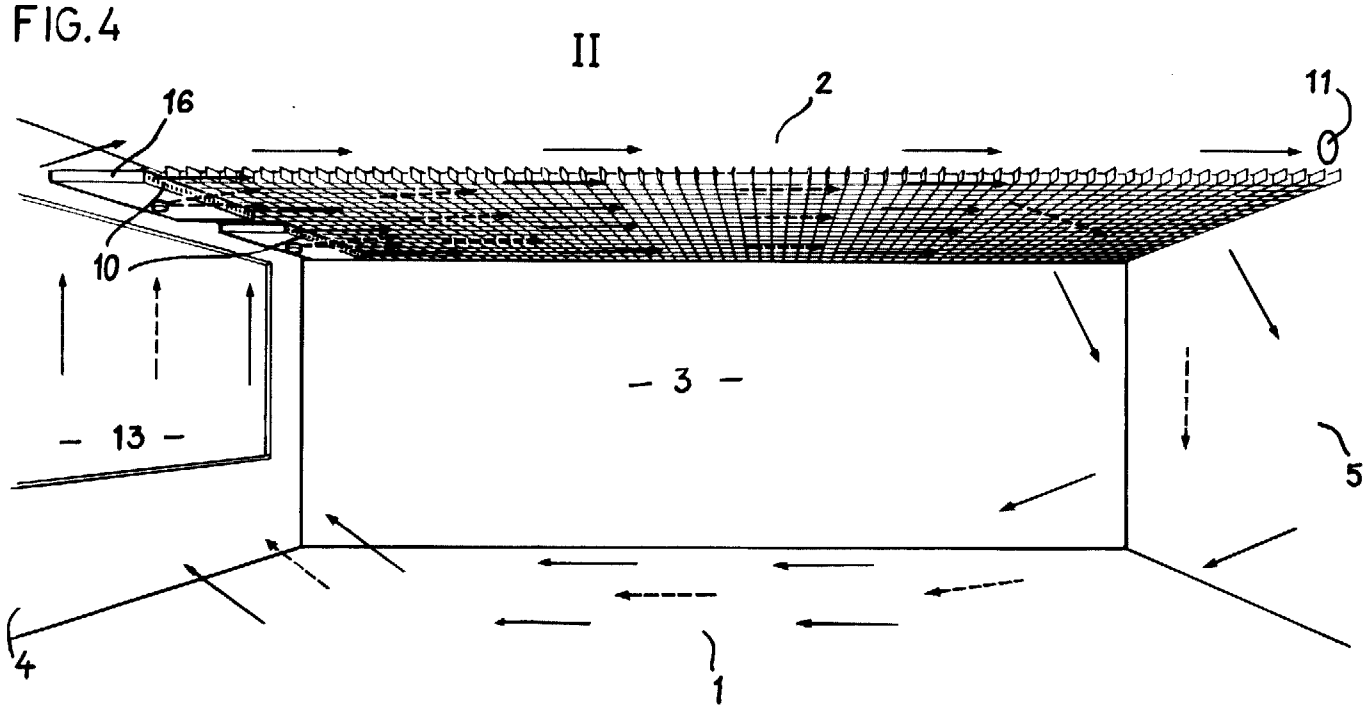
FIG. 4 is a perspective view of a room ventilated by a modification of the process of the invention, as seen from the side.
Figure 5:
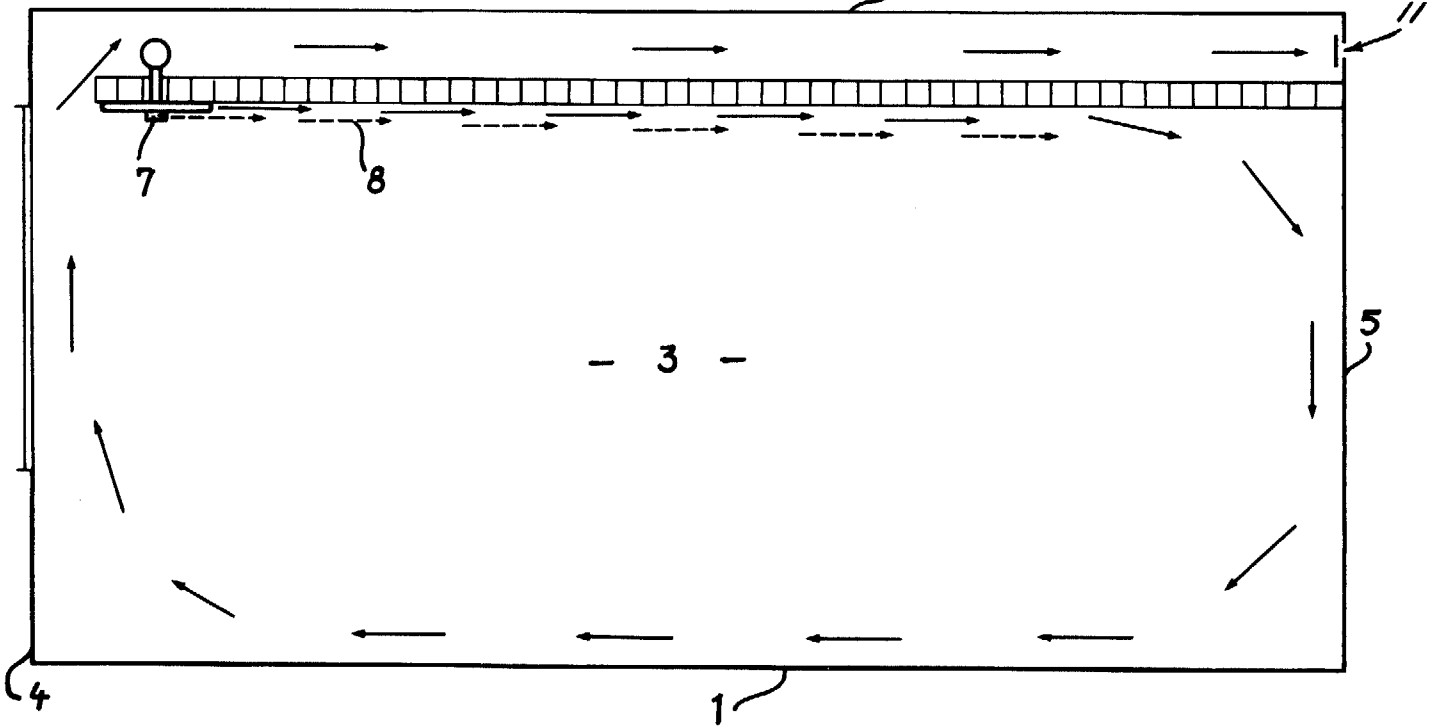
FIG. 5 shows the room of FIG. 4 in an isometric side view.
Figure 7:
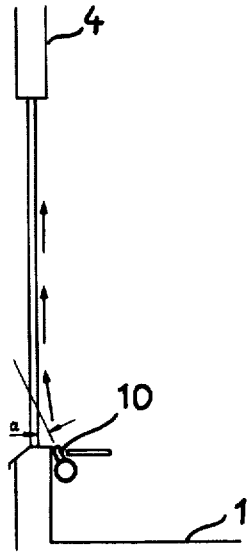
FIG. 7 is a side view of the arrangement of FIG. 6.
Figure 9:
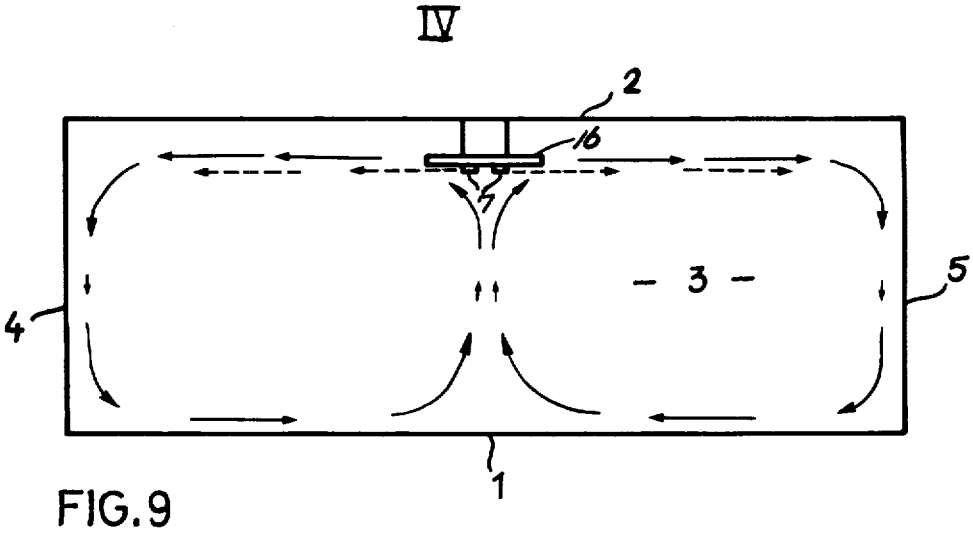
FIG. 9 is a side view of a further modification of the invention for use in a room.
Figure 8:
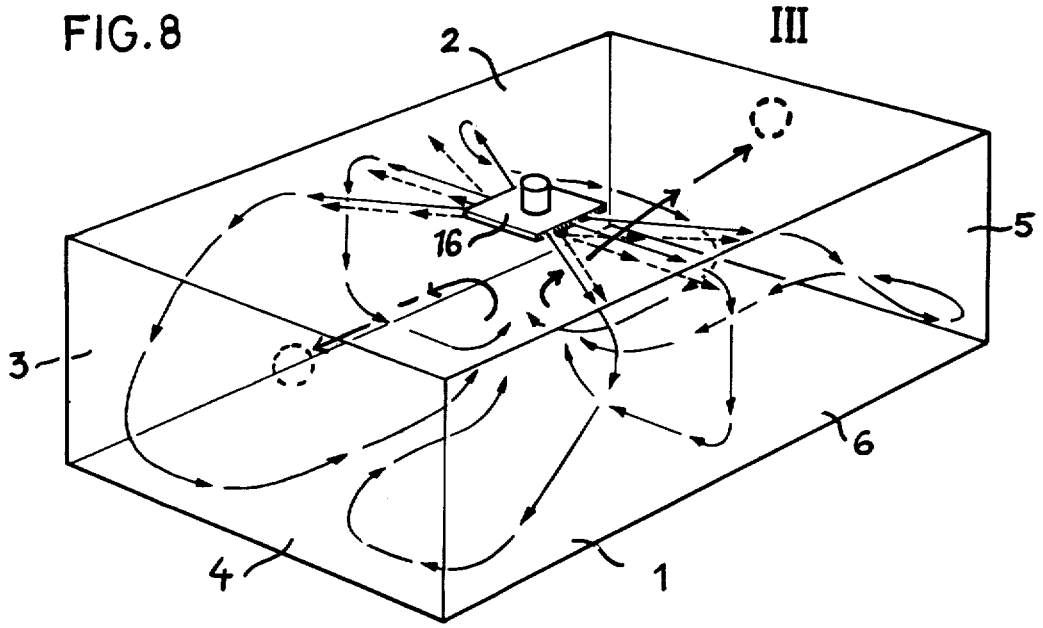
FIG. 8 is a perspective view of a room ventilated by a further-modified process according to the invention.
Figure 10:
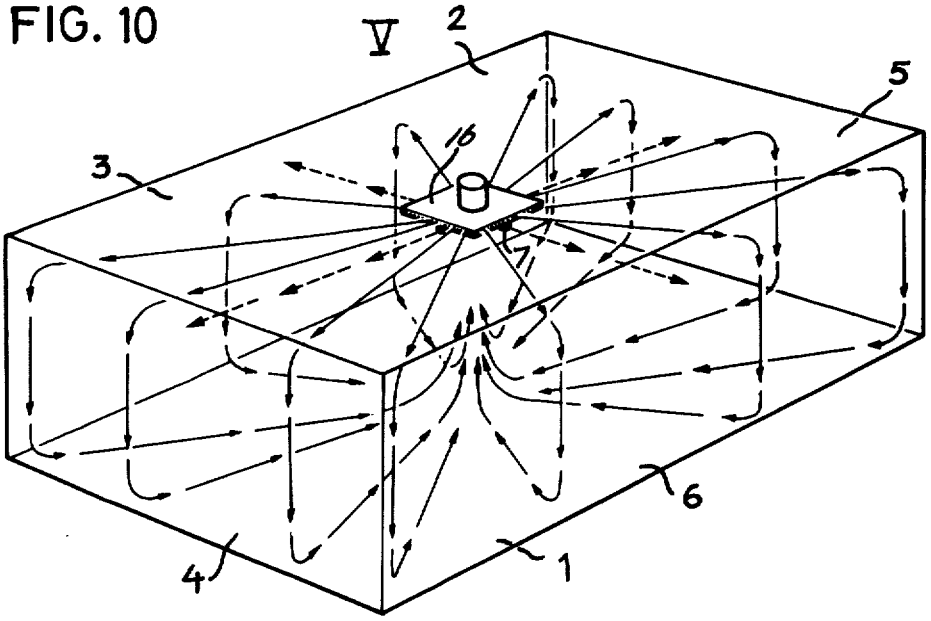
FIG. 10 is a perspective view of a room ventilated by a further modification of the invention.
Figure 11:
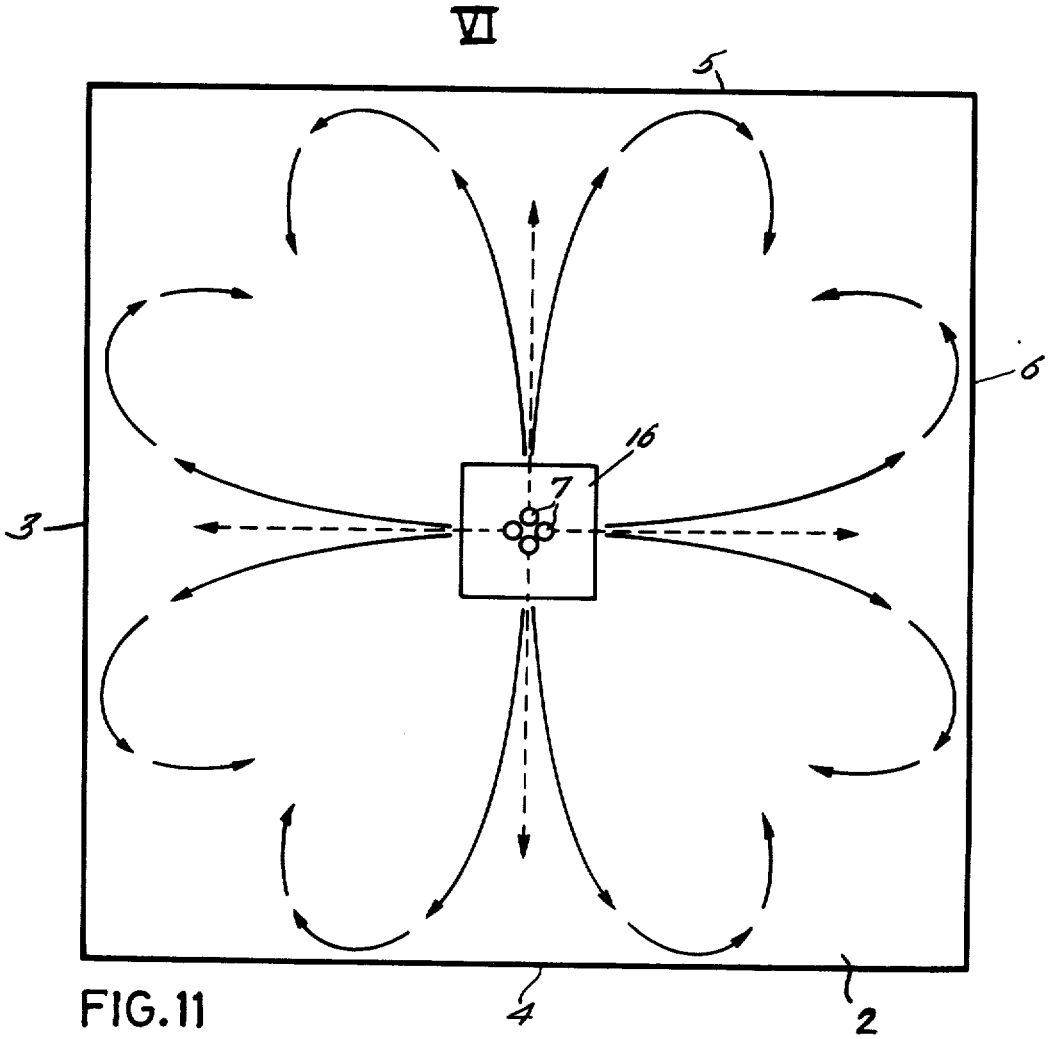
FIG. 11 is a bottom view of a room ventilated by a further process of the invention.

The embodiment of the process and apparatus of FIGS. 1 and 3 is designated I, that of FIGS. 4 and 5 is designated II, that of FIG. 8 is designated III, that of FIG. 9 is designated IV, that of FIG. 10 is designated V, and that of FIG. 11 is designated VI. FIG. 2 relates to both I and also II; while FIGS. 6 and 7 may each be associated with any of the described processes or contrivances. This division is however not a categoric one, and it is possible to use any desired combination of various details and of entire systems.

In the various examples of construction, the same or equivalent parts are designated by the same reference numerals. Thus the room shown in the various figures has 1 designating a floor, 2 a ceiling, and 3 to 6 walls. 7 designates inlet nozzles, and 8 designates the streams emitted by the nozzles and are indicated by broken lines, with arrows showing the flow directions. The supplied tempering or ventilating air is shown by solid lines 9 with arrows, and the inlets or the like for the supplied ventilating or tempering air are designated 10. 11 designates outflow openings or the like; and 12 designates an intermediate ceiling, preferably consisting of upright and crossing lamellae of a rasterlike general appearance. Finally in certain figures there is shown a window 13 in the one wall 4. To this extent there is at least a common character to the various examples of construction shown in the various figures. In order to make this description easy to read, in the following the ventilating or tempering air is termed VT-air. By this is meant that this air is provided to ventilate and/or temper a room. Such a room is in the drawings shown only in parallelopiped form. This is naturally not a limitation; the invention self-evidently applies to any shape of room.

As shown by FIGS. 1 to 3, VT-air is introduced with an upward direction of flow along a central region of the one wall 4, which preferably is a wall having a window. In this case the VT-air inlet is made as a relatively long gap parallel to wall 4 and formed in a window-sill 14 or in some suitable offset. Thanks to the orientation of the inlet and of the air supply flow, the VT-air flows upward against the ceiling 2, where it is given a right-angles bend, so as to continue to follow the ceiling toward the opposite wall 5. Here the VT-air becomes deviated downward to follow the wall 5 and flow in the direction toward the floor 1, where it becomes deviated at right-angles to follow the floor, and so as to finally leave the room through outlets 11, preferably disposed under the VT-air inlet. In this way an at least approximately closed circuit is obtained, and a very good distribution of the VT-air in the air in the room.

The described path of the VT-air would be only a wished-for dream unless the following measures were taken in accordance with the invention. These measures consist chiefly in the arrangement of inlet nozzles 7 at a certain distance A from wall 4. These nozzles 7 have, at a certain distance from the ceiling 2, flat heads, provided with lengthwise and/or crosswise slits 15, which may be made adjustable if desired and are directed horizontally toward wall 5. Out of these slits 15 flow fanned-out air jets or screening air jets, which in the following will be termed F-air or S-jets respectively. The pattern of the jets 8 is shown in FIG. 2, where the central zones are shown by dashed lines from three S-nozzles, and by dotted lines from two F-nozzles.

Thus the F-air spreads out in a horizontal plane at a spacing from the ceiling 2 and also below the flow zone of the VT-air. At a relatively short distance from the F-nozzles the F-jets merge to form a substantially united plane, which prevents the VT-air from going down to the central zone of the room. The F-jets thus so-to-say form their own intermediate ceiling below the ceiling 2, which F-intermediate ceiling supports the VT-air above it. At the walls 3, 5, 6, the F-air flows downward, then along the floor, to leave the room through outlets 11 or the like. When the F-air encounters the walls 3, 5, 6, it becomes mixed with the VT-air, and thus follows it. However the F-air has already achieved its purpose. This is in the prevention of the VT-air from going down into the central region of the room. That central region may be considered to be the region enclosed by the walls and ceiling and spaced inwardly therefrom by 0.5 to 1 meter, for example.

It may be desirable to have the VT-air flow downward also at the walls 3 and 6. To achieve this, it is merely necessary to make a suitable flattening of the F-air mouthpiece 7, e.g. to produce the pattern as shown by the dotted lines in FIG. 2. As a result, the central regions of the F-jets do not reach the walls 3 and 6, so it is possible for the VT-air to go downward as shown in FIG. 1. The marginal regions of the F-air then also follow the walls 3 and 6, as shown in FIG. 1.

Even when F-air mixes with the VT-air at the walls 3, 5 and 6, it acts there to a certain extent to guid or conduct the VT-air. The F-air, because of its greater speed in comparison with the VT-air, holds back the VT-air outside the central zone of the room, and by impulse and suction compels the VT—air to stay as near as possible to the walls 3, 5 and 6, and also to the floor 1.

In accordance with a preferred way of carrying out the invention, the F-air is given exactly the desired room temperature, while the temperature of the VT-air may be above or below the desired room temperature, depending chiefly on the prevailing outdoor temperature conditions.

It is very advantageous to install an intermediate ceiling 12 in the room, which may consist of parallel horizontally-extending lamellae having their width dimension upright. They may however be set crosswise, as shown in the drawings, Such an intermediate ceiling, of a known form per se, has in this connection a novel guiding influence on both the VT-air and the F-air. The crosswise vertical lamellae do not permit air flow to pass obliquely through the intermediate ceiling. However, a purely vertical movement is possible. This is shown in FIG. 1, from which it follows that the VT-air passes straight through the intermediate ceiling and straight downward at the walls 3, 5, 6, along which it flows. The intermediate ceiling thus forms a reinforced zone of separation between the F-jet plane and the VT-air zone below the ceiling 2. In the whirling mass, a small marginal part of the F-jets and/or VT-air encounters the transverse lamellae, and the eddies at both sides of the intermediate ceiling so-to-say form an air-cushion, which still more effectively separates the two streams from one another. The eddies hereby ensure that the main streams are kept at a distance from the intermediate ceiling. Near the wall 5 however the F-air momentum has diminished, while at the same time a so much higher VT-air pressure has built up above the intermediate ceiling that the VT-air can pass straight downward through the intermediate ceiling and along wall 5. The foregoing condition is the same at walls 3 and 6, when the F-air momentum is kept small in those regions.

The intermediate ceiling 12 may advantageously be spaced somewhat away from wall 4 and/or the other walls. Naturally the lamellae must not be set flat, nor extend along a vertical plane. Although the form of intermediate ceiling shown and described may be regarded as very advantageous, naturally many forms of intermediate ceiling may be used. It is here even possible to imagine a substantially integral intermediate ceiling, spaced somewhat apart from at least walls 4 and 5.

The form of construction shown in FIGS. 4 and 5 differs from what has been described in the foregoing, in that the VT-air is introduced parallel to and substantially simultaneously into the same general region as the F-air, but slightly above it. For this purpose, flat boxes 16 are provided above and adjacent the nozzles. These boxes 16 or the like may be directly under the intermediate ceiling 12 or at a corresponding height, and may be provided with inlet openings 10, which point in the same direction as the gap 15, i.e. toward the wall 5. In this case the VT-air is transported into a very flat zone between the F-jet plane 8 and the intermediate ceiling 12. At the wall 5 there then occur substantially the same conditions as in the previous example, and the VT-air as well as the F-air then pass along the floor 1 toward the wall 4. In this case preferably no outlet openings are provided at wall 4, but the air flow there turns upward along the window 13 and into the region between the intermediate ceiling 12 and the ceiling 2, or into the zone above the VT-air. Directly under the ceiling 2 there are then disposed in the wall 5 one or more outlet openings 11, through which the air flow can then leave the room. The advantage of this design is that both the VT-air and the F-air are compelled to make a longer movement in the locality than is the case for the approximately circular movement in the preceding example. Here it makes an approximately sigma-shaped movement, and in particular the VT-air can therefore provide a substantially greater amount of the contemplated ventilating-tempering effect. Naturally it is also possible in this case to wash the walls 3 and 6 with VT-air and F-air, e.g. by providing the boxes 16 with openings turned toward the walls 3 and 6.

Figure 6:
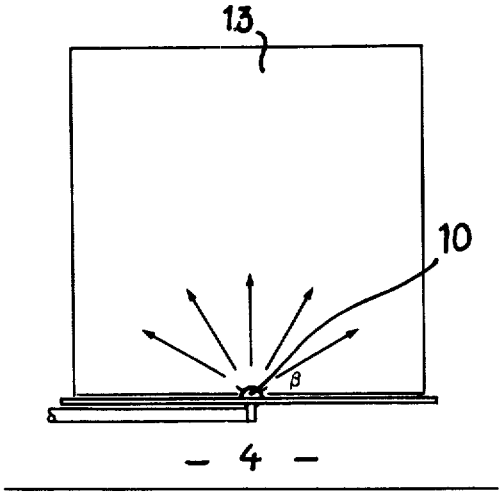
FIG. 6 shows an apparatus for supplying air to a room in accordance with the invention, in a front view.

The example shown in FIGS. 6 and 7 is applicable to all the forms of construction of the invention, but is however particularly advantageous for the design of FIGS. 4 and 5, i.e. for a corresponding extension of it. As shown by FIGS. 5 and 6, below the window 13 is a VT-air inlet 10 with a broad gap (not shown) which is directed at an upward slant toward the window. Through this inlet, or a number of them in the case of larger windows, sole or supplementary VT-air is brought which spreads out fanwise, and thus washes over substantially the entire window 13, so as then to enter the space under the ceiling 2, and in its further course to travel the already-described path. By means of such an arrangement there is effectively prevented the familiar stream of cold air at windows during low outdoor temperatures. At the same time there is naturally also a great advantage when high outdoor temperatures prevail and the window should be cooled. Such nozzles 10 may thus be used along with or instead of the boxes 16. In supplementary installations these mouthpieces produce at the window an advantageous suction effect.

In FIGS. 8, 9, 10 and 11 are shown modifications of the examples of FIGS. 4 and 5. Here too use is made of a box-like distributor 16 for VT-air, and below that are disposed F-air nozzles. Differing from FIGS. 4 and 5, the distributor 16 with F-air mouthpieces 7 is in FIGS. 8 to 11 situated centrally under ceiling 2 at a spacing from it. With such a central arrangement it is advantageous that, at two opposite sides of the distributor, there by openings for the outflow of the VT-air with suitable directed F-air nozzles 7. FIGS. 8 and 9 show such a distribution of air in two opposite directions; while FIGS. 10 and 11 show air streams directed to all four walls. In all these cases however it is naturally possible to have an intermediate ceiling of the described kind. With the examples of FIGS. 8 to 11 the room outlet openings may be at any desired locations, e.g. in the region where the ceiling 2 meets the walls. It may however also be advantageous to have such room outlet openings below or between F-air mouthpieces 7. In this last-named region there exists underpressure, and the VT-air and also the F-air may, after intensively washing over the ceiling, the walls and the entire floor, ascend in a smooth flow to available outflow openings. In FIG. 10, for example, a suitable location of the outlet openings might be between the F-air mouthpieces or below. As has been said, in FIG. 8 it may be advantageous to put an outlet opening centrally in the upper region of the walls 4 and 5 respectively, so that air streams directed to the walls 4 and 5 are obtained, although the distributor 16 does not send any direct air stream toward them.

The forms of construction described in the foregoing and shown in the drawings are to be regarded merely as non-limiting examples, which may be modified and supplemented as desired within the scope of the invention and the following claims.

What is claimed is:

1. A process for controlling the flow in a room of air controllably conditioned as to its temperature and/or freshness to maintain air in the central portion of said room at or near a predetermined desired temperature and/or freshness, comprising:

launching one or more jets of control air along a plane generally parallel and near to the ceiling of said room but spaced downwardly therefrom, from a launching location positioned near but downwardly of said ceiling, to form a sheet of rapidly-moving control air spaced below and generally parallel to said ceiling over a major portion of the area of said ceiling; and injecting a flow of said conditioned air into the region of said room above said jets of air and along said ceiling in a direction generally parallel to the direction of flow of the adjacent portion of said sheet of control air;

moving the control air in said sheet at a velocity high compared with said flow of conditioned air and serving to confine said flow of conditioned air substantially to a path extending through said region over at least a major portion of the area of said ceiling.

2. The process of claim 1 in which said flow of conditioned air is initially introduced into said room upwardly along a first sidewall of said room, and said sheet of control air is introduced initially into said room at a position inwardly of said first sidewall, whereby said conditioned air flows initially upward along said first sidewall and then between said sheet of control air and said ceiling.

3. The process of claim 1, in which said sheet of control air is formed by injecting said control air into said room from separate spaced nozzles to produce fan-like air streams which merge to form said sheet.

4. The process of claim 3, in which said fan—like air streams have central regions of higher air momentum than at their edges and are oriented so that said central regions do not impinge at least one sidewall of said room.

5. The process of claim 1, also comprising providing a horizontally-extending intermediate ceiling of spaced-apart upright lamellae positioned between said sheet of control air and said flow of conditioned air along said ceiling thereby further impeding oblique downward flow of said ventilating-tempering air into said central portion of said room.

6. The process of claim 1, comprising also introducing an additional stream of conditioned air at and along a boundary of said room in a direction and position to enhance said flow of conditioned air about the periphery of said room.

7. The process of claim 6, in which said additional stream is introduced at and along a window-containing portion of a sidewall of said room.

8. The process of claim 1, in which said flow of conditioned air is introduced initially into said room at a position between the plane of said sheet of control air and said ceiling.

9. The process of claim 8, in which said control air and said conditioned air are initially introduced at substantially the same lateral position in said room.

10. The process of claim 9, in which said conditioned air and said control air are guided about the boundaries of said room so as to return to the zone of said room intermediate said region in which said conditioned air and said control air are initially introduced and said adjacent room boundary, and exhausting said returned air from said room at a position adjacent said intermediate zone.

11. A process according to claim 1, in which said conditioned air and said control air are both initially introduced into said room at a position beneath and adjacent the center of the ceiling of said room and each along the same plurality of different lateral directions.

12. A process according to claim 11, comprising exhausting air from said room at a position beneath and adjacent the position of introduction of said control air into said room.

13. A process according to claim 11, comprising exhausting said air from said room through at least one of the sidewalls of said room.

* * * * *